United States Patent [19]

Stapleton

[11] 4,120,451

[45] Oct. 17, 1978

[54] CURRENCY CONVERTER FOR USE WITH PRE-ESTABLISHED AND KNOWN CONVERSION DATA

[76] Inventor: Gerald F. Stapleton, 967 St. Mary's La., Santa Barbara, Calif. 93111

[21] Appl. No.: 684,085

[22] Filed: May 7, 1976

[51] Int. Cl.[2] ..... G06G 1/02

[52] U.S. Cl. ..... 235/89 R; 235/70 A

[58] Field of Search ..... 235/70 R, 70 A, 70 C, 235/78, 84, 88, 89

[56] References Cited

U.S. PATENT DOCUMENTS

| | | | |
|---|---|---|---|
| 3,680,775 | 8/1972 | Schwarz et al. | 235/71 A |
| 3,795,795 | 3/1974 | Galbransen | 235/70 A |

FOREIGN PATENT DOCUMENTS

| | | | |
|---|---|---|---|
| 350,864 | 6/1931 | United Kingdom | 235/89 R |

*Primary Examiner*—Lawrence R. Franklin
*Attorney, Agent, or Firm*—Daniel J. Meaney, Jr.

[57] ABSTRACT

A currency converter formed of a fixed frame having a hollowed-out central area and two flat parallel surfaces wherein one surface defines two large generally parallel windows having a section of one reference line of indicia extending lengthwise across the top and bottom of each window wherein each section designates a range of currency of a reference country in the form of a logarithmic scale of currency values, a first and second small window positioned between the two large windows for displaying in one of the small windows an exchange rate comprising the currency value of the reference country for each unit of currency of a selected country and in the other small window an exchange rate comprising the units of currency of a selected country for each unit of currency of the reference country and with the other surface designing a plurality of apertures formed into at least two columns of spaced aligned apertures extending in a direction substantially perpendicular to the large windows, and a removeable slider positioned within and moveable through the central area having exchange currency indicia designating a range of currency units positioned to be viewed through the two large windows, a second line of indicia designating currency units of the reference country for each unit of currency of the selected country positioned to be viewed through one of the two small windows and on the opposite side thereof in a predetermined position the names of selected countries having units of currency in the range of exchange currency indicia and a listing of the unit of currency of a selected country and a method for using the converter is shown.

11 Claims, 7 Drawing Figures

CURRENCY CONVERTER FOR USE WITH PRE-ESTABLISHED AND KNOWN CONVERSION DATA

BACKGROUND OF THE INVENTION

I. Field of the Invention

This invention relates to a currency converter and to a method for calculating and displaying units of currency of a reference country to the currency value of a selected country at an exchange currency rate which generally is in current use between such countries. In addition, if the exchange currency rate or reciprocal thereof is known, the currency converter is adapted to be precisely set at the currency value of a reference country for each unit of currency of a selected country or vice versa. A method for using the calculator to convert currency values between a reference country and a selected country is disclosed.

II. Description of the Prior Art

Currency converters are well known in the art. Typical of the present currency converters are the deviced disclosed and claimed in the U.S. Pat. Nos. 3,680,775 and 3,795,795.

The currency converter described in U.S. Pat. No. 3,680,775 utilizes an elongated slide member, and endless belt having a circumference slightly greater than the sum of twice the length plus twice the thickness of the slide member which is moveably mounted around the slide member and a sleeve member adapted to receive the assembled elongated slide member and endless belt. In order to use the calculating device disclosed in U.S. Pat. No. 3,680,775, it is necessary to first position the endless belt on a predetermined position relative to the elongated slide member. It is necessary for the user to know or to have reference to the then existing exchange currency rate in order to use the calculating device at all for currency conversion from the currency of a reference country to a selected country.

The currency converter of U.S. Pat. No. 3,795,795 utilizes a first moveable frame, a fixed frame which encloses the first moveable frame and a second moveable frame which encloses the assembly formed of the fixed frame and first moveable frame. In order for a user to make any meaningful currency conversion, it is necessary to again independently ascertain the then currency exchange rate between the currency of the reference country and a selected country and pre-set the converter with such information. Once the then current exchange rate is known, the first moveable frame is adjusted relative to the fixed frame to set the then prevailing rate and the second moveable frame is adjusted relative thereto to enable the user to calculate the units of currency of a selected country.

In each of the above devices, it is necessary for the user to independently ascertain the then current exchange rate and to pre-set or program the calculator before being able to make a currency conversion. Generally, a user is desireous of knowing the approximate currency exchange rate for purpose of making initial currency conversion. Thus, in the absence of exchange rate information, such devices are rendered useless.

Further, in the currency calculator of U.S. Pat. No. 3,680,775, the user must carefully adjust the endless belt relative to the elongated slide to assure proper alignment between the indicia on the endless belt and premarked zones on the elongated slide member in order to insure appropriate conversion rates and location of the decimal point for the units of conversion.

It is, therefore, an object of this invention to provide a currency converter and method for enabling a user to make a currency conversion for a currency value of a reference country to the units of currency of a selected country without ascertaining or programming the currency converter with the then current exchange rate information.

It is another object of this invention to provide a currency converter and method to enable a user to utilize a known currency exchange rate in terms of currency value of the reference country to units of currency of a selected country or vice versa between the currency of a reference country and a selected country for precisely programming the calculator enabling a conversion of currency values of the reference country for units of currency of a selected country or vice versa.

It is a further object of this invention to provide a currency converter and method for converting a currency value of U.S. currency ranging from about $0.10 to $10,000.00 into units of currency of any one of a plurality of selected countries.

It is yet another object of this invention to provide a plurality of moveable slider members having indicia representing units of currency on one surface thereof and selected countries having units of currency within the range of indicia contained on the slider member including designating the name of the unit of currency for such country, which moveable slide member is adapted to be inserted into and utilized with the same fixed member for conversion of the currency exchange rate between United States currency and units of currency represented by the indicia on the selected moveable slider.

It is still another object of this invention to enable a user to make currency conversion from the currency of a reference country to currencies of selected countries without the necessity of setting a decimal point.

It is a further object of this invention to enable a user to convert from a currency of one selected country to the currency of a second selected country.

SUMMARY OF THE INVENTION

These and other objects of the invention are accomplished in reference to one embodiment of the invention in which a fixed frame defines two large viewing openings and two smaller viewing openings on one side thereof and a plurality of aligned spaced apertures formed into equal substantially parallel columns on the other side thereof, and a removeable slider positioned within and moveable through the fixed frame to position indicia on the removeable slider in certain positions within the viewing window to enable a user to compare indicia on the slider as viewed through the various viewing windows and to fixed indicia or a name of a country positioned relative to a viewing window and aperture respectively in order to make conversions of currency value of a reference country to units of currency of a selected country.

In the preferred embodiment of the present invention, the reference currency is U.S. dollars. The range of currency values is from about $0.10 to $10,000.00 United States dollars. The units of currency of a selected country are printed on a plurality of removeable slider members, each of which represents a predetermined range of units of currency. In the preferred embodiment, six removeable slider members are utilized which designate units of currency from 0.03 to 7,000,000 units of currency. By use of such removeable slider members together with the fixed frame, units of currency of a substantial number of countries throughout the world can be easily converted to the currency values of United States currency, all without the user independently ascertaining the then existing currency exchange rate between the United States and a selected country or to keep track of the decimal point.

This invention has wide utility and use. The preferred embodiment of the invention has particular utility as a world wide currency and exchange rate reference, business calculator, marketing and sales device and for education and training purposes. Other applications include use of the device as an effective advertising medium or advertising device wherein a business, bank, firm or other entity could fix an advertising message or other message into the device and to distribute the same to user, customers of the like for a number of purposes.

BRIEF DESCRIPTION OF THE DRAWING

These and other objects of the invention, together with its various features and advantages can be more easily understood from the following more detailed description taken in conjunction with the accompanying drawing in which.

DESCRIPTION OF THE PREFERRED EMBODIMENT

Figure 1:
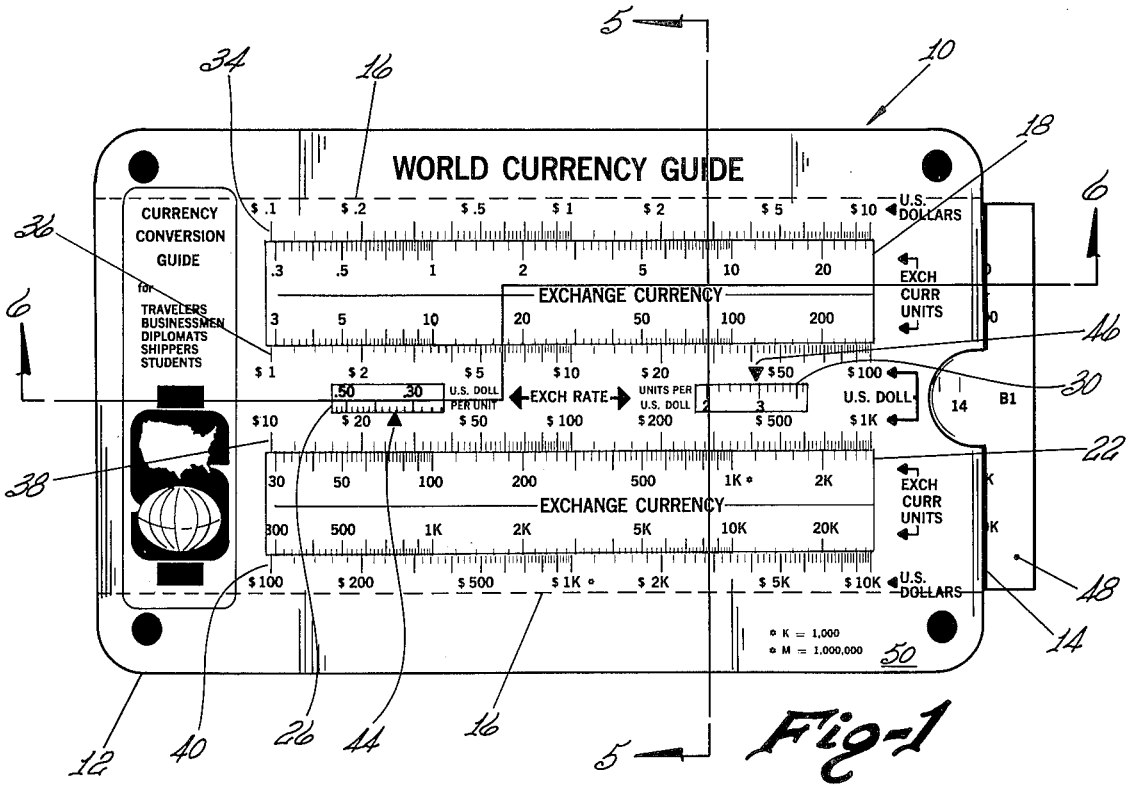
FIG. 1 is a front view of an assembled currency converter.

The currency converter of the present invention, designated generally as 10, is shown in FIG. 1. The currency converter 10 comprises a fixed frame 12 having means defining a hollowed-out central area 14 (as represented by dash lines 16). The fixed frame 12 includes means for defining a first opening, such as for example large viewing window 18, which extends lengthwise across the frame 12. In the preferred embodiment, the fixed frame 12 may include a second viewing window 22, which second viewing window is of substantially the same dimension as the first large viewing window 18 and positioned in a space parallel aligned relationship thereto.

The fixed frame 12 further defines a second opening such as a first small viewing window 26. The first smaller viewing window 26 has a dimension which is substantially less than that of the first large viewing window 18 and is positioned in spaced parallel alignment with the first large viewing window 18. In the currency converter 10 of FIG. 1, the first small viewing window 26 and a second smaller viewing window 30, which is of substantially the same size and dimension as viewing window 26, are positioned in equal distance between the viewing windows 18 and 20 and in alignment with each other.

Large viewing windows 18 and 22 have an upper and lower surface and have at least one reference line of indicia extending thereacross. For example, viewing windows 18 and 22 of FIG. 1 collectively have four sections representing the reference line of indicia designating a range of currency of a reference country in the form of a logarithmic scale of currency values. In particular, viewing window 18 has a first section 34 and a second section 36 which represent a selected range of currency values for U.S. currency. Similarly second large viewing window 22 has a third and fourth section of reference line indicia 38 and 40, respectively, designating different ranges of currency of United States currency. In this embodiment, the currency converter 10 of FIG. 1 has sections of the reference line indicia having the following ranges:

(a) A first section ranging from $0.10 to $10.00;

(b) A second section ranging from $1.00 to $100.00;

(c) A third section ranging from $10.00 to $1,000;

(d) A fourth section ranging from $100.00 to $10,000.00.

The first small viewing window 26 has a first reference mark 44 designating a unit of currency of a selected country to be converted into the currency value of the reference country. Specifically, in the embodiment illustrated in FIG. 1 small viewing window 44 designates currency value of a selected country. Similarly, the second small viewing window 30 has a second reference mark 46 designating the units of currency of a selected country for a unit of currency of the reference country. In particular, in the embodiment shown in FIG. 1, small view window 30 designates units of currency per United States dollar. The information displayed in small window 26 and 30 is generally referred to as the currency exchange rate or reciprocal thereof.

A removeable slider 48 is positioned within and moveable through the central area 14. The front surface of the fixed frame 12 defining the above described view windows may be generally referred to as a first parallel surface 50.

Figure 2:
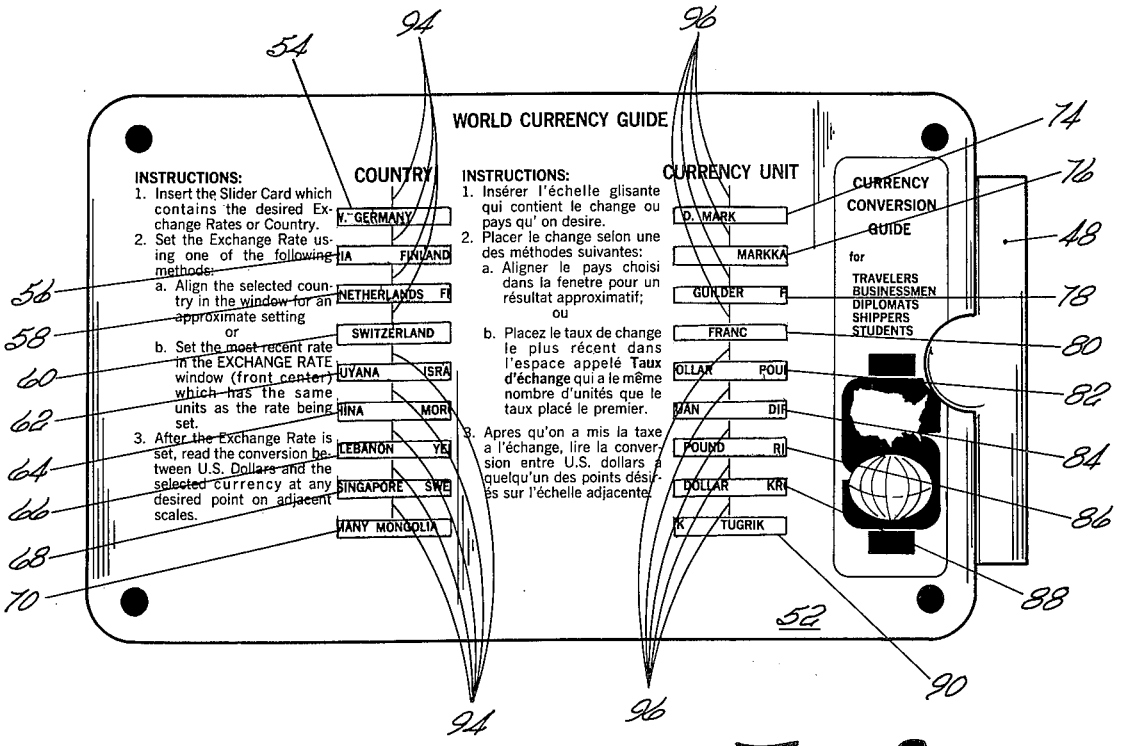
FIG. 2 is a back view of an assembled currency converter.

FIG. 2 illustrates the back view of an assembled currency converter having a second parallel surface generally designated as 52. The second parallel surface defines a plurality of apertures, such as aperture 54 through 70, inclusive, which are formed into at least one column of spaced apertures which extend in a direction substantially perpendicular to the large viewing window 18 and 22. In the embodiment shown in FIG. 2, a second column of a plurality of apertures 74 through 90, inclusive, are formed into a second column of spaced apertures which are positioned substantially parallel to the first column of apertures and wherein each aperture is in alignment with a corresponding aperture in the opposite column. For example, aperture 60 in column one is in space alignment with aperture 80 of column two. Each aperture in column one has positioned relative thereto a programmed reference mark 94 and each aperture in column two has a reading reference mark 96 positioned relative thereto. The programmed reference mark on second surface 94 is used to align the name of a selected country relative thereto to set an exchange currency rate which is an approximation of the then exchange currency rate between the units of currency of the country set in an aperture of column one to United States dollars represented on first surface 50 of FIG. 1. Concurrently, the name of the currency unit for the selected country is aligned with the reading reference mark 96 of the opposite aligned aperture in column two to that displaying the selected country.

Figure 3:
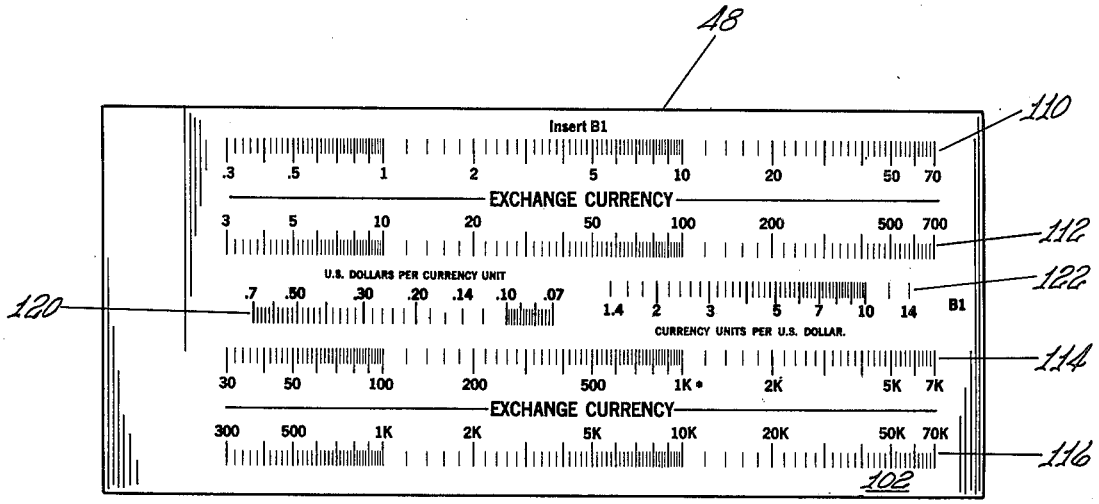
FIG. 3 and 4 are the front and back view, respectively of removeable slider B-1.
Figure 4:
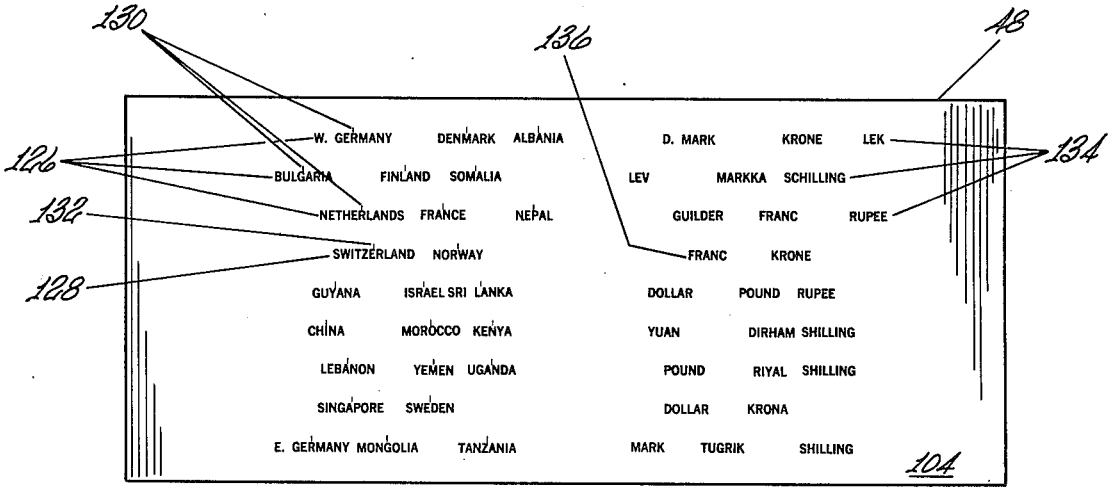

FIG. 3 and 4 show the removeable slider generally designated as 48 which is adapted to be positioned within the fixed frame 12 and moveable through the central area 14, both shown in FIG. 1. In the embodiment of the slider shown in FIG. 3 and 4, this removeable slider is generally referred to as "Insert B1" having a first slider surface 102 as shown in FIG. 3 and second slider surface 104 as shown in FIG. 4.

In FIG. 3, the first slider surface has at least one exchange currency line of indicia designating a range of currency units representing currency values in the form of a logarithmic scale of currency units. In the embodiment of FIG. 3 and 4, appropriate sections of the currency line of indicia are adapted to be viewed through appropriate large viewing windows 18 and 22 in fixed frame 12, shown in FIG. 1. In the embodiment of FIG. 3, the sections of the units of currency are as follows:

(a) a first section having a range of units of currency from 0.3 to 70;

(b) a second section having a range of units of currency from 3 to 700;

(c) a third section having a range of units of currency from 30 to 7,000; and (d) a fourth section having a range of units of currency from 300 to 70,000.

The four sections of the units of currency are represented by sections 110 through 116, respectively.

In addition, the first surface 102 of slider 48 includes a second line of indicia representing the currency value of the reference country's present currency unit of a selected country, such as U.S. dollars per currency unit as shown by line of indicia 120. In addition, the first surface includes a separate second line of indicia designating the currency units of a selected country per unit of currency of the reference country, such as currency units per U.S. dollars designated as line of indicia 122. The U.S. dollars per currency unit shown by indicia 120 and currency units per United States dollars shown by indicia 122 are displayed through the first and second small viewing windows 26 and 30, respectively, in surface 50 of frame 12 as shown in FIG. 1.

The second slider surface 104 on slider 48 as shown in FIG. 4 includes a plurality of names of selected countries generally designated as 126 and including specifically the country of Switzerland shown specifically as country 128. Each name of a country 126 has a set mark positioned thereabove, such as the set mark generally designated as 130 positioned above each country designated as the name of the country 126. In particular, the name of the country of Switzerland 128 has a set mark 132 positioned thereabove.

On the opposite end of the same surface 102 in FIG. 4, also positioned in selected locations are the names of units of currency generally designated as 134 for the appropriate names of country 126. In particular, the currency of Switzerland 128 is the franc as shown by the unit of currency 136 labeled "franc". The position and location of the names of the countries, units of currency and apertures may be in any desired combination or array, the only requirement being that the logarithmic scales on the front surface are positioned relative to each other reflecting the appropriate currency exchange. For example, the position of the name of the country and units of currency could be reversed.

Figure 5:
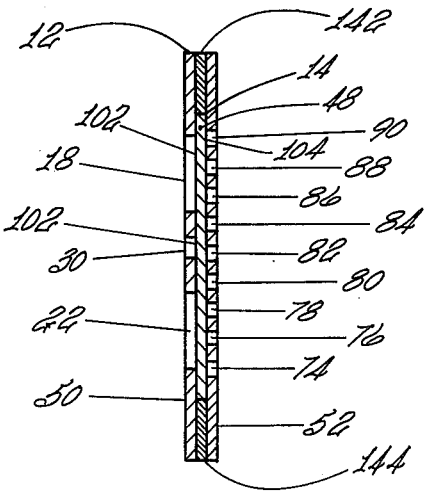
FIG. 5 is a sectional taken along section line 5—5 of FIG. 1.

FIG. 5 shows in cross section (not to scale) the assembled currency converter 10. The fixed frame 12 has as its first and second parallel surface 50 and 52 respectively separated by a top spacer 142 and a bottom spacer 144. Planar surfaces 50 and 52 in cooperation with spacers 142 and 144 define the hollowed-out area 14. The removeable slider 48 is positioned within and moveable through the central area 14.

The large viewing windows 18 and 22 are positioned to enable the indicia on surface 102 of slider 48 to be viewed there through. Similarly, the small viewing window 30 is positioned to read the indicia on surface 102 of slider 48. The second planar surface 52 of frame 12 shown in FIG. 2 when assembled is inverted relative to the first planar surface 50 of FIG. 1. Thus, the currency unit is positioned upside down and on the right side of the slider as viewed in FIG. 1. This results in apertures 74 through 90 being positioned with aperture 90 at the top thereof.

Figure 6:
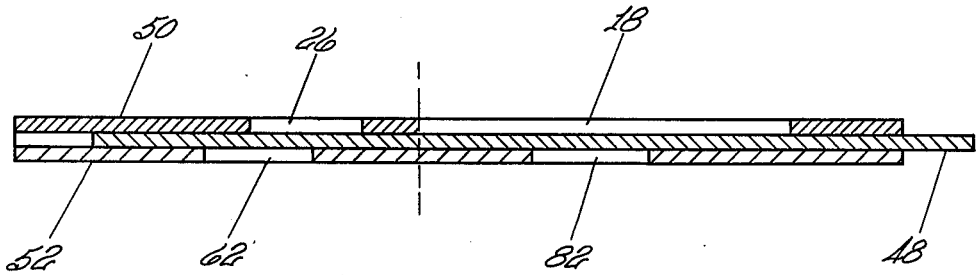
FIG. 6 is a sectional view of the assembled currency converter taken along section line 6—6 of FIG. 1.

The cross-sectional view of FIG. 6 (not to scale) shows the front surface 50, the second surface 52 and the slider as assembled. The first small viewing window 26 and large viewing window 18 are formed in the first surface 50. Similarly, apertures 62 and 82 formed in the second surface 52 and positioned adjacent with the slider 48 and are part of a column of apertures and extend in a substantially perpendicular to large viewing windows 18 and 22.

Figure 7:
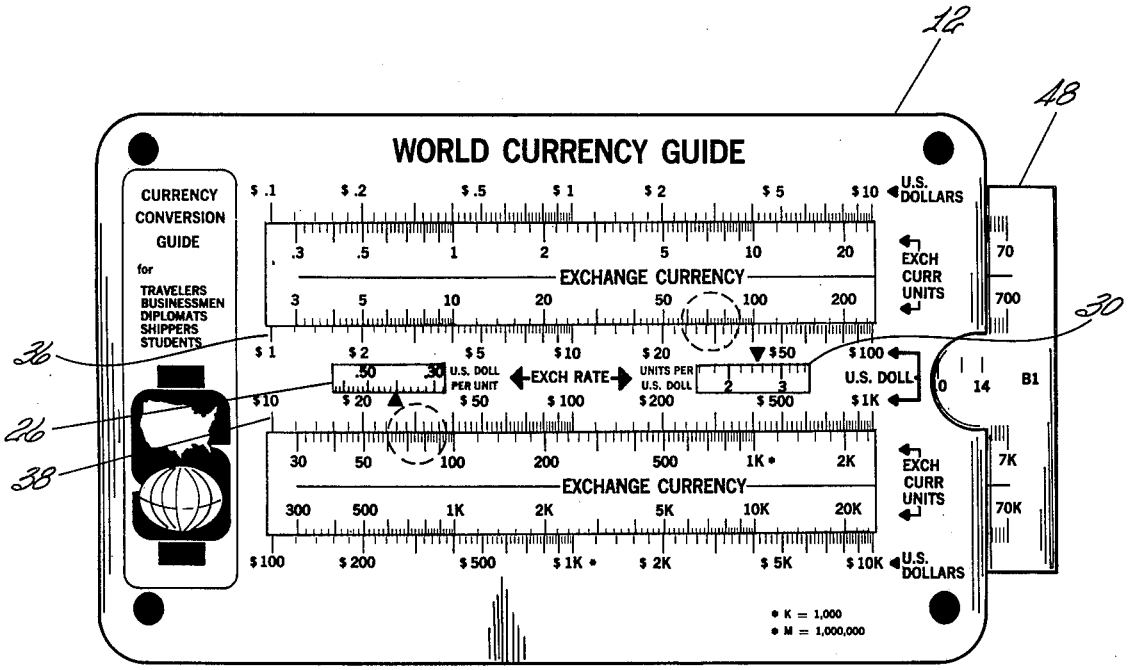
FIG. 7 is an assembled currency converter showing a precise conversion of United States currency to Swiss francs.

FIG. 1 and 7 together show one example of a use of the currency converter showing a conversion between United States dollars and Swiss Francs. The generally established currency rate was set by aligning the set mark 132 above the country Switzerland 128 (both shown in FIG. 4) relative to the programmed reference mark 94 positioned above aperture 60. An example of a conversion using the setting is shown in FIG. 1. Large windows 18 and 22 in surface 50 are shown in FIG. 1 to be set at the approximate currency exchange rate between U.S. dollars and Swiss francs. In the peferred embodiment disclosed in FIGS. 1 to 7 inclusive, a currency converter is designed to be a converter which is capable of use as a method or means for converting between United States dollars and other major currencies.

In the embodiment of FIG. 1, the currency converter consists of a faced frame 12 and six inserts, labeled A1, A2, B1, B2, C and D. Each of the inserts cover the following units of currency. However, the number of inserts is not critical, but the use of six inserts enables the user to obtain direct conversions of currency without regard for decimal point. For example, the exchange rate of a currency may be $1 U.S. equals 300 units of currency of a country. This could well be shown as 3 units times $10^2$ which require the user to mentally convert the number to 300.

| Slider Insert | Range of Units of Currency |
|---|---|
| $A_1$ | .03 - 7,000 |
| $A_2$ | .03 - 7,000 |
| $B_1$ | .3 - 70,000 |
| $B_2$ | .3 - 70,000 |
| C | 3 - 700,000 |
| D | 30 - 7,000,000 |

A series of inserts are used to provide scale changing for the wide range of rates required. Card inserts A and B are used twice to allow the listing of more countries on the back. In FIG. 2, when a country name is aligned in one of the apertures 54 to 70 marked "COUNTRY", this sets up a recent exchange rate for use as reference until a more accurate rate is obtained. It is this feature which enables a user to use the converter without the necessity of knowing exchange rates. In addition, it is not necessary to preset or preprogram the converter to obtain an approximate exchange rate. However, if a precise exchange rate is required, the item current rate is set by a slight adjustment of the slider to set the exact exchange rate in small windows 26 and 30. Note that the currency unit for that country appears in the corresponding apertures 74 to 90 on the right in FIG. 2, marked "CURRENCY UNIT".

The conversion between United States dollars and the selected currency can be done at any point along the adjacent logarithmic scales on the front. The outer frame contains United States dollars scales while the selected currency units are read from the sliding insert scales. Note also that scales are repeated to provide overlapping readings regardless of the position of the insert. For example, the 1 to 10 United States dollars scale at the upper right is repeated at the left hand edge of the next scale below it. If the sliding insert were moved to the left (in setting the rate) so that the 10 dollar mark is "off scale", the conversion from 10 dollars could be made on the lower scale.

After the exchange rate is set as described above, the user may convert between any United States dollar amount on the fixed frame scales and the selected currency units on the adjacent moveable scales. This procedure may be verified with the following example:

Example 1 shown in FIG. 1:

Convert 30 U.S. dollars into Swiss francs.

(a) From the list of countries, Switzerland is on Insert B1. Card B1 is placed in the fixed frame (See FIG. 2)

(b) on the back side, align the set mark 132 for Switzerland with the programmed reference mark 94 on the aperture 60 under COUNTRY.

(c) on the front side find 30 on the fixed scale and read 87 on the slider scale. Then 30 U.S. dollars = 87 francs. This is shown in FIG. 1. Note that small viewing window 26 shows that a franc is worth about 0.34 U.S. dollars and small viewing window 30 shows that $1 U.S. is worth about 2.9 franc.

(d) If a more recent exchange rate is known (for example, 2.5 francs per U.S. dollar) set this new rate in window 30, as shown in FIG. 7, by slightly moving slider 48.

(e) In FIG. 7, on the fixed scale 36 and 38 at 30 dollars, the equivalent exchange currency is set to display 75 francs. Note that the exchange rate displayed in small window 26 is likewise adjusted to reflect the precise United States dollar currency value for a franc. Another example is as follows:

How many U.S. dollars is the equivalent of 3200 Italian lira if the current rate is 0.0016 dollars per lira?

(a) From the list of countries, we find that Insert D must be used.

(b) Since the rate is in dollars per lira, use the left hand window 26 to set this exchange rate. Note that the inverse rate (approximately 630 lira per dollar) appears in the right hand window 30.

(c) At a point opposite the 3200 index mark, read the conversion as 5 U.S. dollars. Since FIGS. 1, 2 and 7 utilize slide B-1, this example is not illustrated in the drawing.

In addition, the user may convert the currency of one selected country, for example Chinese — Yuan, to the currency of a second selected country for example — West Germany —D. Mark without knowing the exchange rate. This is accomplished by using $1 U.S. as the intermediary between countries.

The currency converter of the present invention provides an easy method of converting from a currency value of a reference country to units of currency value of a selected country including the steps of moving the moveable slide member within the center area of the fixed frame aligning the set mark over the name of a selected country in alignment with the programmed reference mark above an aperture located on the back side of the frame member, reading the units of currency value shown on the slider as viewed through a large window which is in alignment with a desired currency value of United States dollars to be converted into units of currency of the country having the set mark alignment with the programmed reference mark and reading the currency value of the reference country per unit of currency of the selected country in the small viewing window on the front side of the converter.

The converter disclosed herein may be used for other than a currency converter. For example the items to be converted may use a precious metal, such as gold, for the reference item. Other items, the selected items, may be converted relative to the quantity value of gold. Thus, in its broadest application, the converter may be used to convert quantities of a reference item, designated as a range of quantities of a reference item in the form of a logarithmic scale of quantity numbers, to units of quantity of a selected item represented by a quantity line of indicia designating a range of quantity units representing quantity numbers in the form of a logarithmic scale of quantity units.

Likewise, the method of using the converter for such conversion by the preprogrammed or programmed method may be used.

What is claimed is:

1. A converter adapted to be programmed for use by pre-established conversion data and known conversion data comprising a fixed frame having means defining a hollowed-out central area extending axially therethrough, a first opening extending lengthwise across the frame and having extending lengthwise in parallel thereto at least one reference line of indicia designating a selected range of a quantity of a reference item in the form of a logarithmic scale;

a second opening positioned in spaced relationship with said first opening and having a first reference mark designating a unit of a reference item to be converted into a quantity number of a selected item; and a third opening positioned in a spaced relationship with said first opening and said second opening and having a second reference mark designating the reciprocal of the conversion displayed in said second opening at said first reference mark;

means defining a first aperture and a program reference mark positioned at a predetermined location adjacent the aperture, and means defining a second aperture having a reading reference mark positioned at a predetermined location adjacent the second aperture;

a removable slider positioned within and movable through said central area and having at least one exchange quantity line of indicia designating a selected range of a quantity of a selected item in the form of a logarithmic scale adapted to be viewed through said first opening;

a separate second line of indicia designating quantity numbers of said selected item adapted to be viewed through said second opening;

a separate third line of indicia designating quantity numbers of said reference item adapted to be viewed through said third opening;

a first pre-established conversion data bearing area having in a predetermined position names identifying groups of units of a corresponding selected item to be converted between the reference indicia and the selected indicia, each of said identifying name being adapted to be selectively viewed through said first aperture when set adjacent said program reference mark; and a second pre-established conversion data bearing area having in a predetermined position the name of a unit of the selected item corresponding to the identifying name contained in said first pre-established conversion data information bearing area, said name of the unit of a selected item being adapted to be viewed through the second aperture adjacent the reading reference mark in response to the identifying name being positioned adjacent said program reference mark;

said lines of indicia having a pre-established relationship therebetween wherein the range of the quantity of the selected item of said exchange quantity line is fixed relative to the range of quantity numbers of a selected item represented by the second line of indicia and the quantity numbers of the reference item represented by the third of indicia, said relationship being established by the predetermined locations of each of said line of indicia affixed to said slider;

said slider being responsive to being programmed relative to the frame for conversion between the reference item and selected item by at least one of positioning the slider to locate the pre-established conversion data in the form of an identifying name in the first aperture adjacent the programmed reference mark, positioning the slider to locate the pre-established conversion data in the form of a name of a unit of a selected item in the second aperture adjacent the reading reference mark, positioning the slider to locate a known quantity of units of a reference item for a unit of a selected item adjacent the first reference mark in the second opening, and positioning the slider to locate a known quantity of units of a reference item for a unit of selected item adjacent the first reference mark in the third opening;

said slider when so programmed simultaneously displaying the conversion between the quantity of a selected item per unit of a reference item and the reciprocal thereof adjacent the reference mark in said second and third opening respectively and setting the at least one exchange quantity of indicia relative to said first opening wherein the conversion between quantity of units of a reference item and quantity of units of a selected item can be read directly between each of the logarithmic scales.

2. The converter of claim 1 wherein the first, second and third openings are formed on one side of the fixed frame and the apertures are formed on the opposite side of the frame and said lines of indicia are formed on the slider on the side to be displayed through said first, second and third openings and the first and second pre-established conversion data bearing areas are formed on the slide on the other side thereof to be displayed through the apertures.

3. The converter of claim 1 wherein said means defining said first aperture forms a first column of aligned apertures each of which has a program reference mark, said means defining said second aperture forms a second column of aligned aperture each of which has a reading reference mark and wherein said first pre-established conversion data bearing area contains a plurality of identifying names of groups of units of different corresponding selected items and said second pre-established conversion data bearing area contains a plurality of names of units of different corresponding selected items.

4. The converter of claim 3 wherein said reference item is dollars of United States currency and wherein said selected items are units of currency of countries foreign to the United States, the identifying names being the names of the country and the names of units of a corresponding selected item being the name of a unit of currency in the corresponding country.

5. A currency converter adapted to be programmed for use by pre-established currency conversion rates and known currency conversion rates comprising a fixed frame having means defining a hollowed-out central area extending axially therethrough;

a first opening extending lengthwise across the frame and having extending lengthwise in parallel thereto at least one reference line of indicia designating a selected range of units of currency of a reference currency in the form of a logarithmic scale;

a second opening positioned in spaced relationship with said first opening and having a first reference mark designating a unit of currency of the reference currency to be converted into a quantity of currency units of a selected currency; and a third opening positioned in a spaced relationship with said first opening and said second opening and having a second reference mark designating the reciprocal of the currency conversion rate displayed in said second opening at said first reference mark;

means defining a first aperture and a program reference mark positioned at a predetermined location adjacent the aperture, and means defining a second aperture having a reading reference mark positioned at a predetermined location adjacent the second aperture;

a removable slider positioned within and movable through said central area and having at least one exchange quantity line of indicia designating a selected range of currency units of the selected currency in the form of a logarithmic scale adapted to be viewed through said first opening;

a separate second line of indicia designating a quantity of currency units of the selected currency adapted to be viewed through said second opening;

a separate third line of indicia designating a quantity of currency units of the reference currency adapted to be viewed through said third opening;

a first pre-established conversion data bearing area having in a predetermined position names of countries of a corresponding selected unit of currency to be converted between the reference indicia and the selected indicia, each of said name of the country being adapted to be selectively viewed through said first aperture when set adjacent said program reference mark; and a second pre-established conversion data bearing area having in a predetermined position the name of a selected unit of currency corresponding to the country name contained in said first pre-established conversion data information bearing area, said name of a selected unit of currency being adapted to be viewed through the second aperture adjacent the reading reference mark in response to the country name being positioned adjacent said program reference mark;

said lines of indicia having a pre-established relationship therebetween wherein the range of the quantity of units of currency of the selected currency of said exchange quantity line is fixed relative to the range of quantity of units of currency of a selected currency represented by the second line of indicia and the quantity of units of currency of the reference currency represented by the third of indicia, said relationship being established by the predetermined locations of each of said line of indicia affixed to said slider;

said slider being responsive to being programmed relative to the frame for conversion between the reference currency and selected currency by at least one of positioning the slider to locate the pre-established conversion data in the form of a country name in the first aperture adjacent the programmed reference mark, positioning the slider to locate the pre-established conversion data in the form of a name of a unit of currency of a selected currency in the second aperture adjacent the reading reference mark, positioning the slider to locate a known quantity of units of currency of a reference currency for a unit of currency of a selected currency adjacent the first reference mark in the second opening, and positioning the slider to locate a known quantity of units of currency of a reference currency for a unit of currency of selected currency adjacent the first reference mark in the third opening;

said slider when so programmed simultaneously displaying the conversion between the quantity of units of currency of a selected currency per unit of currency of a reference currency and the reciprocal thereof adjacent the reference mark in said second and third opening respectively and setting the at least one exchange quantity of indicia relative to said first opening wherein the conversion between quantity of units of currency of a reference currency and quantity of units of currency of a selected currency can be read directly between each of the logarithmic scales.

6. The currency converter of claim 5 wherein the first, second and third openings are formed on one side of the fixed frame and the apertures are formed on the opposite side of the frame and said lines of indicia are formed on the slider on the side to be displayed through said first, second and third openings and the first and second pre-established conversion data bearing areas are formed on the slide on the other side thereof to be displayed through the apertures.

7. The converter of claim 5 wherein said means defining said first aperture forms a first column of aligned apertures each of which has a program reference mark, said means defining said second aperture forms a second column of aligned apertures each of which has a reading reference mark and wherein said first pre-established conversion data bearing area contains a plurality of country names of units of currency of different corresponding selected currencies and said second pre-established conversion data bearing area contains a plurality of names of units of currency different corresponding selected currencies.

8. The currency converter of claim 7 wherein said reference currency is United States currency and wherein said selected currencies are units of currency of countries foreign to the United States.

9. The currency converter of claim 8 wherein said fixed frame defines a fourth opening of substantially the same dimension as said first opening and positioned and spaced alignment therewith and in spaced parallel alignment with said first, second and third openings;

and having extending length in parallel thereto at least one reference line of indicia designating a selected range of units of currency of a reference currency in the form of a logarithmic scale; and said removable slider includes a separate fourth line of indicia designating a quantity of units of currency of a selected currency in the form of a logarithmic scale adapted to be viewed through said fourth opening.

10. The currency converter of claim 9 wherein said reference lines of indicia adjacent said first and fourth openings represents the currency of the country of the United States of America and said sections of the line of indicia adjacent the first opening comprise a first section ranging from \$0.10 to \$10;

a second section ranging from \$1 to \$100; and said sections of the line of indicia adjacent the fourth opening comprise a third section ranging from \$10 to \$1,000; and a fourth section ranging from \$100 to \$10,000.

11. The currency converter of claim 10 wherein the sections of the exchange currency line of indicia are within a range of units of currency of a selected currency which range from 0.03 to 7,000,000 units.

* * * * *